US008851845B2

(12) United States Patent
Brittingham et al.

(10) Patent No.: US 8,851,845 B2
(45) Date of Patent: Oct. 7, 2014

(54) TURBOMACHINE VANE AND METHOD OF COOLING A TURBOMACHINE VANE

(75) Inventors: Robert Alan Brittingham, Piedmont, SC (US); Robert Walter Coign, Piedmont, SC (US)

(73) Assignee: General Electric Company, Schenectady, NY (US)

( * ) Notice: Subject to any disclaimer, the term of this patent is extended or adjusted under 35 U.S.C. 154(b) by 863 days.

(21) Appl. No.: 12/948,361

(22) Filed: Nov. 17, 2010

(65) Prior Publication Data

US 2012/0121415 A1 May 17, 2012

(51) Int. Cl.

*F01D 5/08* (2006.01)
*F01D 9/02* (2006.01)
*F01D 5/18* (2006.01)

(52) U.S. Cl.

CPC ..... *F01D 9/02* (2013.01); *F05D 2260/202* (2013.01); *F01D 5/187* (2013.01); *F05D 2240/81* (2013.01); *F01D 5/186* (2013.01); *F05D 2260/201* (2013.01)

USPC ..... 416/96 R; 416/193 A

(58) Field of Classification Search

USPC .... 415/115; 416/95, 96 R, 97 R, 96 A, 193 A

See application file for complete search history.

(56) References Cited

U.S. PATENT DOCUMENTS

| | | | | |
|---|---|---|---|---|
| 3,834,831 | A * | 9/1974 | Mitchell | 416/95 |
| 4,017,207 | A * | 4/1977 | Bell et al. | 415/115 |
| 4,017,213 | A | 4/1977 | Przirembel | |
| 4,105,364 | A | 8/1978 | Dodd | |
| 5,344,283 | A | 9/1994 | Magowan et al. | |
| 5,413,458 | A | 5/1995 | Calderbank | |
| 6,120,249 | A * | 9/2000 | Hultgren et al. | 416/97 R |
| 6,254,333 | B1 | 7/2001 | Merry | |
| 6,343,911 | B1 * | 2/2002 | Burdgick | 415/115 |
| 6,406,254 | B1 * | 6/2002 | Itzel et al. | 415/115 |
| 6,644,920 | B2 * | 11/2003 | Beeck et al. | 416/97 R |
| 6,652,220 | B2 | 11/2003 | Powis et al. | |
| 6,951,444 | B2 | 10/2005 | Dellmann et al. | |
| 7,001,141 | B2 | 2/2006 | Cervenka | |
| 7,097,417 | B2 * | 8/2006 | Liang | 415/115 |
| 7,147,431 | B2 | 12/2006 | Maguire et al. | |
| 7,255,536 | B2 | 8/2007 | Cunha et al. | |
| 7,467,922 | B2 | 12/2008 | Beeck et al. | |
| 7,841,828 | B2 * | 11/2010 | Liang | 415/191 |
| 7,927,073 | B2 * | 4/2011 | Scott et al. | 416/97 R |
| 8,118,554 | B1 * | 2/2012 | Liang | 416/97 R |
| 2002/0085909 | A1 | 7/2002 | Bekrenev | |

FOREIGN PATENT DOCUMENTS

| | | |
|---|---|---|
| WO | 8201033 | 4/1982 |

* cited by examiner

*Primary Examiner* — Richard Edgar
*Assistant Examiner* — Ryan Ellis
(74) *Attorney, Agent, or Firm* — Cantor Colburn LLP

(57) ABSTRACT

A turbomachine includes a housing, and at least one turbine vane arranged within the housing. The at least one turbine vane includes a platform portion operatively connected to the airfoil portion. A cooling cavity is formed in the platform portion. The cooling cavity includes a first wall, a second wall arranged opposite the first wall, a third wall linking the first and second walls, and a fourth wall linking the first and second walls and positioned opposite the third wall. An impingement cooling plate extends into the cooling cavity and defines an inner cavity portion and an outer cavity portion. The impingement cooling plate including at least one impingement cooling passage that is configured and disposed to guide an impingement cooling flow onto at least one of the first, second, third and fourth walls of the cooling cavity.

20 Claims, 4 Drawing Sheets

TURBOMACHINE VANE AND METHOD OF COOLING A TURBOMACHINE VANE

BACKGROUND OF THE INVENTION

The subject matter disclosed herein relates to the art of turbomachines and, more particularly, to a turbomachine vane including an impingement cooling cavity.

In general, gas turbomachines combust a fuel/air mixture that releases heat energy to form a high temperature gas stream. The high temperature gas stream is channeled to a turbine via a hot gas path. In the turbine, the high temperature gas stream passes through a plurality of vanes and acts upon a plurality of turbine blades. The turbine blades convert thermal energy from the high temperature gas stream to mechanical energy that rotates a turbine shaft. The turbine may be used in a variety of applications such as providing power to a pump or an electrical generator.

During operation, the plurality of turbine vanes increase in temperature as a result of interaction with the high temperature gas stream as well as other factors. In order to facilitate a long service life, the plurality of turbine vanes are cooled. Cooling air is diverted away from a combustion chamber portion of the turbomachine and directed to the turbine. The cooling air is then passed through airfoil and platform portions of the plurality of turbine vanes to reduce localized temperatures.

BRIEF DESCRIPTION OF THE INVENTION

According to one aspect of the exemplary embodiment, a turbomachine includes a housing, and at least one turbine vane arranged within the housing. The at least one turbine vane includes an airfoil portion and a platform portion operatively connected to the airfoil portion. The platform portion includes a first surface, an opposing second surface and a side surface that joins the first and second surfaces. A cooling cavity is formed in the platform portion. The cooling cavity includes a first wall, a second wall arranged opposite the first wall, a third wall linking the first and second walls, and a fourth wall linking the first and second walls and positioned opposite the third wall. An impingement cooling plate extends into the cooling cavity and defines an inner cavity portion and an outer cavity portion. The impingement cooling plate including at least one impingement cooling passage that is configured and disposed to guide an impingement cooling flow onto at least one of the first, second, third and fourth walls of the cooling cavity.

According to another aspect of the exemplary embodiment, a turbine blade includes an airfoil portion, and a platform portion operatively coupled to the airfoil portion. The platform portion includes a first surface, an opposing second surface and a side surface that joins the first and second surfaces. A cooling cavity is formed in the platform portion. The cooling cavity includes a first wall, a second wall arranged opposite the first wall, a third wall linking the first and second walls, and a fourth wall linking the first and second walls and positioned opposite the third wall. An impingement cooling plate extends into the cooling cavity and defines an inner cavity portion and an outer cavity portion. The impingement cooling plate including at least one impingement cooling passage that is configured and disposed to guide an impingement cooling flow onto at least one of the first, second, third and fourth walls of the cooling cavity.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
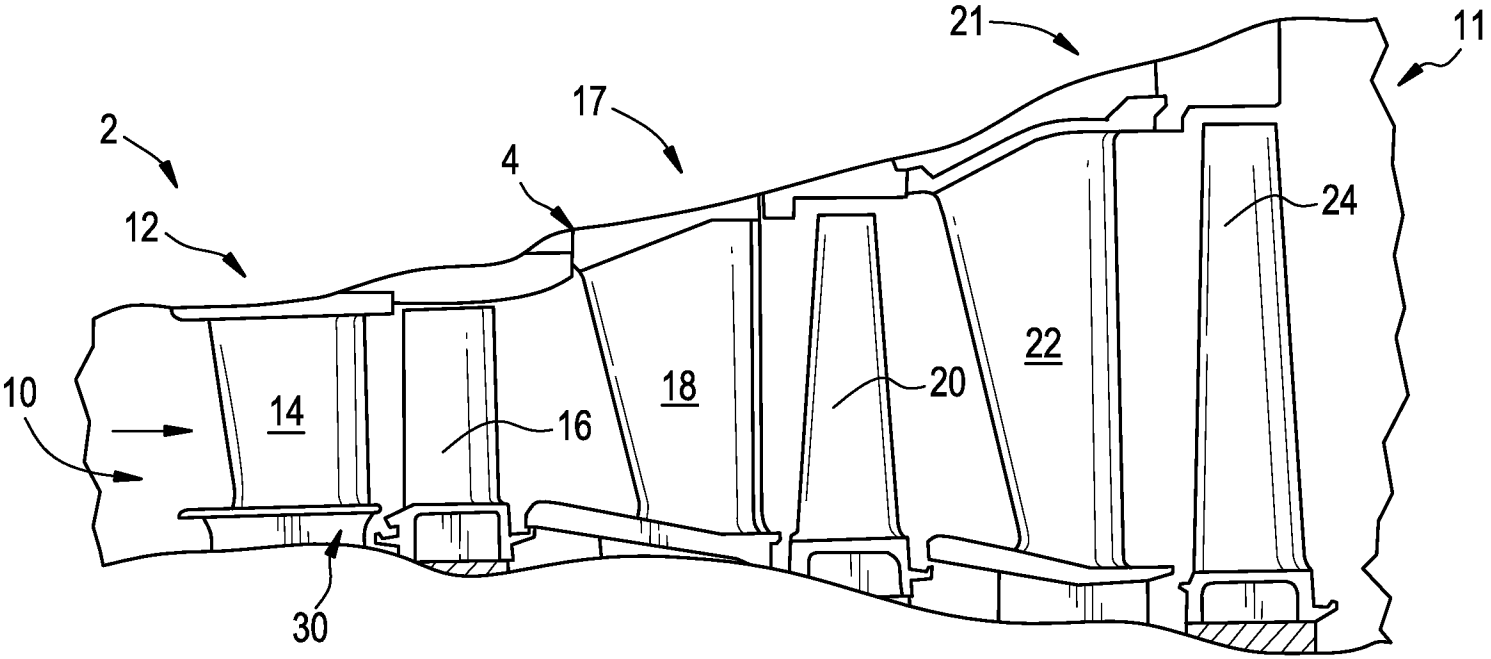
FIG. 1 is a cross-sectional schematic view of a turbomachine including a turbine vane in accordance with an exemplary embodiment.
Figure 2:
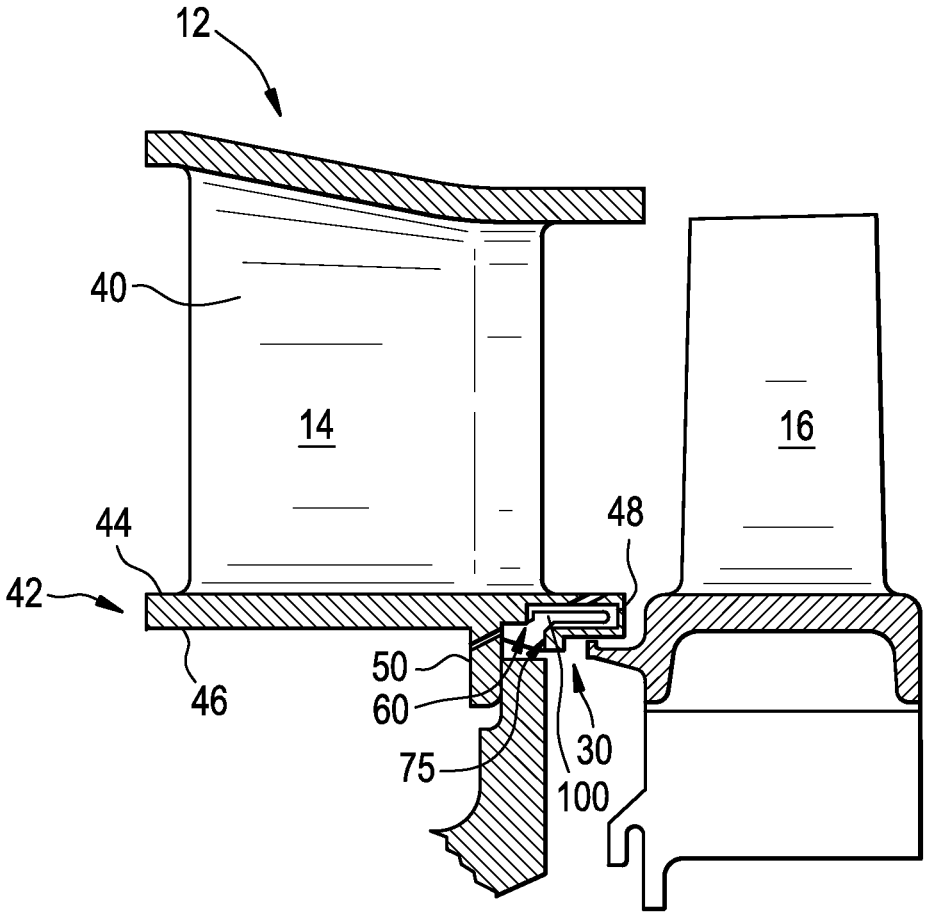
FIG. 2 is a perspective view of the turbine vane of FIG. 1.
Figure 3:
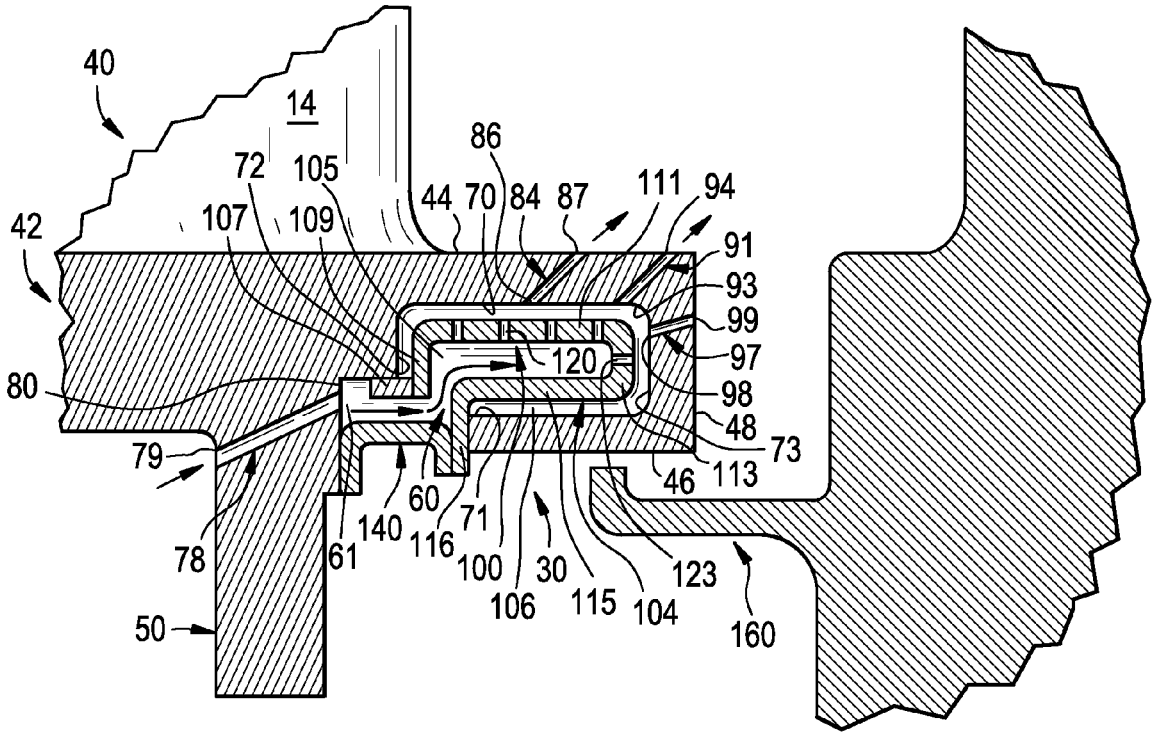
FIG. 3 is a partial cross-sectional view of the turbine vane of FIG. 2 illustrating an impingement cooling cavity in accordance with an exemplary embodiment.

Referring to FIGS. 1-3, a turbomachine, in accordance with an exemplary embodiment, is indicated generally at 2. Turbomachine 2 includes a housing 4 that defines, at least in part, a hot gas path 10 of a turbine portion 11. Turbine portion 11 includes a first stage 12 having a plurality of vanes 14 and blades 16, a second stage 17 having a plurality of vanes 18 and blades 20 and a third stage 21 having a plurality of vanes 22 and blades 24. Of course it should be understood that turbine portion 11 could also include additional stages (not shown). Hot combustion gases flow along hot gas path 10 through vanes 14, 18, and 22, impact and rotate blades 16, 20, and 24. A cooling air flow is guided into turbine portion 11 in order to mitigate thermal fluxes that develop between portions of vanes 14, 18, and 22. In accordance with an exemplary embodiment, a portion of the cooling gases are diverted into a cooling system 30 that is arranged at a downstream end (not separately labeled) of vane 14.

As shown, vane 14 includes an airfoil portion 40 that extends from a base or platform portion 42. Platform portion 42 includes a first surface 44, an opposing second surface 46 and a side surface 48 that links first and second surfaces 44 and 46. Platform portion 42 is also shown to include a flange 50 that extends substantially perpendicularly away from second surface 46 and is adjacent to the down stream end (not separately labeled) of vane 14. Flange 50 is configured and disposed to secure vane 14 in turbine portion 11.

In accordance with an exemplary embodiment, cooling system 30 includes a cooling cavity 60 formed in platform portion 42. As will be discussed more fully below, cooling cavity 60 includes an interior zone 61 that is defined by a first wall 70, a second wall 71 arranged opposite first wall 70, a third wall 72 linking first and second walls 70 and 71, and a fourth wall 73 that also links first and second walls 70 and 71 and is arranged opposite third wall 72. Cooling cavity 60 includes an opening 75 that extends through second wall 71. In the exemplary embodiment shown, opening 75 is covered by an axial extent of airfoil portion 40. That is, opening 75 does not extend into platform portion 44 beyond an outer edge portion (not separately labeled) of airfoil portion 42. In this manner, an axial distance between flange 50 and side surface 48 is minimized. Of course it should be understood that the particular location of opening 75 can vary.

A coolant supply channel 78 extends through platform portion 42 into cooling cavity 60. More specifically, coolant supply channel 78 extends from a first end 79 that is open exposed to compressor discharge air, to a second end 80 that opens into cooling cavity 60. In addition, a first film cooling passage 84 extends through platform portion 42 into hot gas path 10. First film cooling passage 84 extends from a first end 86 that is open to cooling cavity 60, to a second end 87 that opens to hot gas path 10 through first surface 44. Cooling gas flowing through first film cooling passage 84 from cooling cavity 60 creates a film that cools first surface 44. A second film cooling passage 91 extends substantially parallel to first film cooling passage 84. Second film cooling passage 91 extends from a first end 93 that is open to cooling cavity 60, to a second end 94 that opens to hot gas path 10 also through first surface 42. In a manner similar to that described above, cooling gas flowing through second film cooling passage 91 from cooling cavity 60 creates a film that cools first surface 44. Cooling system 30 also includes a third or exhaust cooling passage 97. Third cooling passage 97 extends from a first end 98 that is open to impingement cooling cavity 60, to a second end 99 that opens to hot gas path 10 through side surface 48. With this arrangement, cooling system 30 channels cooling flow though multiple surfaces of platform portion 42.

In further accordance with the exemplary embodiment, vane 14 includes an impingement cooling system 100 that guides an impingement cooling flow onto first and fourth walls 70 and 73 of cooling cavity 60. Impingement cooling system 100 includes an impingement cooling plate 104 that extends within cooling cavity 60 and defines an inner or impingement cavity portion 105 and an outer cavity portion 106. Impingement cooling plate 104 includes a first portion 107 that is connected to platform portion 42. First portion 107 extends to a second portion 109. Second portion 109 leads to a third portion or first impingement cooling surface 111. First impingement cooling surface 111 is spaced from, and extends substantially parallel to, first wall 70. First impingement cooling surface 111 extends to a fourth portion or second impingement cooling surface 113 that is spaced from, and extends substantially parallel to, fourth wall 73. Fourth portion 113 extends to a fifth portion 115 that extends substantially parallel to third portion 111. Fifth portion 115 leads to a sixth portion 116 that connects back to platform portion 42. In the exemplary embodiment shown, impingement cooling plate 104 includes a plurality of impingement cooling passages, two of which are indicated at 120 and 123, that guide a high pressure air flow from impingement cavity portion 105 onto first and fourth walls 70 and 73. The high pressure or impingement flow impinges upon and cools first and fourth walls 70 and 73. After impinging upon first and fourth walls 70 and 73, the impingement cooling flow collects within outer cavity portion 106 and passes out from platform portion 42 through first and second film cooling passages 84 and 91 and exhaust cooling passage 97. Finally, impingement cooling system 100 is shown to include a cooling cavity cover 140 that closes opening 75. As discussed above with respect to opening 75, cooling cavity cover 140 remains within the axial extent of airfoil portion 42 on platform portion 44 so as to maintain a short axial length between flange 50 and side surface 48.

Figure 4:
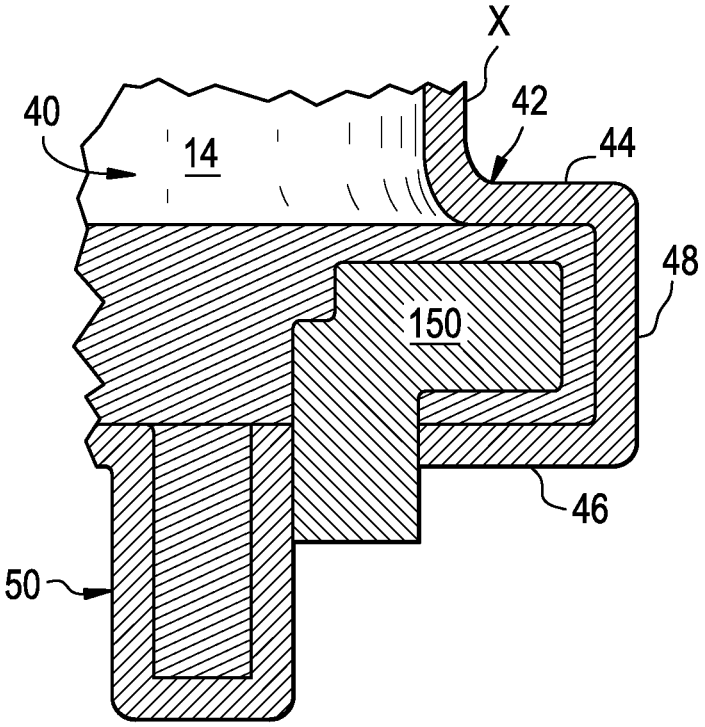
FIG. 4 is a partial cross-sectional view of a platform portion of the turbine vane of FIG. 2 illustrating a method of forming an impingement cooling cavity.

In accordance with one aspect of the exemplary embodiment, cooling cavity 60 is formed by casting vane 14 around a core 150 such as shown in FIG. 4. Core 150 is formed from, for example, ceramic or a ceramic composite. Once vane 14 is formed, core 150 is subjected to an acid bath that dissolves and removes the ceramic. In this manner, impingement cooling cavity is formed in such a way so as to reduce an over all size of opening 75. By maintaining the size of opening 75 and the size of impingement cooling cavity cover 140, relatively small spacing between vanes and blades within turbomachine 2 can be reduced without exposing either component to contact with the other. More specifically, by maintaining opening 75 within the axial extent of airfoil portion 42 on platform portion 44, contact between, for example, an angel wing 160 on blade 16 and impingement cooling cavity cover 140 is eliminated. By shortening the spacing between vanes and adjacent blades without creating localized impact zones, an overall size of turbomachine 2 can be reduced.

At this point it should be understood that while shown and described in connection with vane 14, it should be understood that vanes 18 and 22 could include a similar impingement cooling system. Also, the particular number, size and direction of the impingement cooling passages can vary without departing from the scope of the claims. Finally, while shown arranged in an inner surface of vane 14, it should be understood that the impingement cooling system could be also be arranged on an outer surface of vane 14.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbomachine comprising:

a housing;

at least one turbine vane arranged within the housing, the at least one turbine vane including an airfoil portion and a platform portion operatively connected to the airfoil portion, the platform portion including a first surface, an opposing second surface and a side surface that joins the first and second surfaces;

a cooling cavity formed in an aft end of the platform portion, the cooling cavity including a first wall, a second wall arranged opposite the first wall, a third wall linking the first and second walls and a fourth wall linking the first and second walls and positioned opposite the third wall, each of the first, second, third and fourth walls being integrally formed with the at least one turbine vane; and an impingement cooling plate extending into the cooling cavity and defining an inner cavity portion and an outer cavity portion, the impingement cooling plate including at least one impingement cooling passage that is configured and disposed to guide an impingement cooling flow onto at least one of the first, second, third and fourth walls of the cooling cavity.

2. The turbomachine according to claim 1, wherein the impingement cooling plate includes a first impingement cooling surface and a second impingement cooling surface.

3. The turbomachine according to claim 2, wherein the first impingement cooling surface extends generally parallel to the first wall and the second impingement cooling surface extends generally parallel to the fourth wall.

4. The turbomachine according to claim 3, wherein the at least one impingement opening is formed in the first impingement cooling surface.

5. The turbomachine according to claim 3, wherein the at least one impingement opening includes a first impingement cooling opening formed in the first impingement cooling surface and a second impingement cooling opening formed in the second impingement cooling surface.

6. The turbomachine according to claim 1, wherein the at least one turbine vane includes an opening formed in one of the first and second surfaces of the platform portion, the opening leading to the cooling cavity.

7. The turbomachine according to claim 6, wherein the opening is covered by an axial extent of the airfoil portion.

8. The turbomachine according to claim 6, further comprising: a cooling cavity cover extending across the opening, the cooling cavity cover being detachably mounted to the platform portion and maintained within the axial extent of the airfoil portion.

9. The turbomachine according to claim 1, further comprising: coolant supply channel extending through the platform portion into the cooling cavity.

10. The turbomachine according to claim 1, further comprising: a film cooling passage extending from the cooling cavity through the platform portion, the film cooling passage including an opening exposed at the first surface.

11. The turbomachine according to claim 10, further comprising: another film cooling passage extending from the cooling cavity through the platform portion, the another film cooling passage including an opening exposed at the side surface.

12. A turbine vane comprising:

an airfoil portion;

a platform portion operatively coupled to the airfoil portion, the platform portion including a first surface, an opposing second surface and a side surface that joins the first and second surfaces;

a cooling cavity formed in an aft end of the platform portion, the cooling cavity including a first wall, a second wall arranged opposite the first wall, a third wall linking the first and second walls and a fourth wall linking the first and second walls and positioned opposite the third wall, each of the first, second, third and fourth walls being integrally formed with the platform portion; and an impingement cooling plate extending into the cooling cavity and defining an inner cavity portion and an outer cavity portion, the impingement cooling plate including at least one impingement cooling passage that is configured and disposed to guide an impingement cooling flow onto at least one of the first, second, third and fourth walls of the cooling cavity.

13. The turbine vane according to claim 12, wherein the impingement cooling plate includes a first impingement cooling surface and a second impingement cooling surface.

14. The turbine vane according to claim 13, wherein the first impingement cooling surface extends generally parallel to the first wall and the second impingement cooling surface extends generally parallel to the fourth wall.

15. The turbine vane according to claim 14, wherein the at least one impingement opening is formed in the first impingement cooling surface.

16. The turbine vane according to claim 14, wherein the at least one impingement opening includes a first impingement cooling opening formed in the first impingement cooling surface and a second impingement cooling opening formed in the second impingement cooling surface.

17. The turbine vane according to claim 12, wherein the at least one turbine vane includes an opening formed in one of the first and second surfaces of the platform portion, the opening leading to the cooling cavity.

18. The turbine vane according to claim 17, wherein the opening includes an outer edge that does not extend beyond an axial extent of the airfoil portion.

19. The turbine vane according to claim 17, further comprising: a cooling cavity cover extending across the opening, the cooling cavity cover being detachably mounted to the platform portion and maintained within the axial extent of the airfoil portion.

20. The turbine vane according to claim 12, further comprising: a film cooling passage extending from the cooling cavity through the platform portion, the film cooling passage including an opening exposed at the first surface.

* * * * *